US006945397B2

(12) United States Patent
Brattesani et al.

(10) Patent No.: US 6,945,397 B2
(45) Date of Patent: Sep. 20, 2005

(54) CUSTOMER CUSTOMIZABLE INTERACTIVE PACKAGING AND METHOD FOR USING SAME

(75) Inventors: Steven J. Brattesani, San Francisco, CA (US); Puneet Nanda, Cerritos, CA (US)

(73) Assignee: Dr. Fresh, Inc., Lamiranda, CA (US)

( * ) Notice: Subject to any disclaimer, the term of this patent is extended or adjusted under 35 U.S.C. 154(b) by 13 days.

(21) Appl. No.: 10/691,074

(22) Filed: Oct. 22, 2003

(65) Prior Publication Data

US 2005/0087464 A1 Apr. 28, 2005

(51) Int. Cl.[7] ..... B65D 83/10; B65D 69/00; B65D 85/00

(52) U.S. Cl. ..... 206/362.2; 206/232; 206/459.1

(58) Field of Search ..... 206/232, 459.5, 206/362.2, 362.3, 461, 471, 776; D4/108, 113; 132/308, 309, 310, 311; 40/312, 313

(56) References Cited

U.S. PATENT DOCUMENTS 2,611,476 A * 9/1952 Coney ..... 206/541
5,275,438 A * 1/1994 Struhl ..... 281/31
5,718,336 A * 2/1998 Haarlander ..... 206/542
5,839,575 A * 11/1998 Blanco ..... 206/232
5,984,091 A * 11/1999 Orr et al. ..... 206/232
6,047,820 A * 4/2000 Heinze, IIII ..... 206/232
6,062,233 A * 5/2000 Williams ..... 132/309
6,155,414 A * 12/2000 Vaessen ..... 206/232
6,182,823 B1 * 2/2001 Rinde ..... 206/232
6,397,860 B1 * 6/2002 Hill, II ..... 132/309
6,484,875 B1 * 11/2002 Brainerd et al. ..... 206/232
6,672,783 B1 * 1/2004 Licata et al. ..... 401/123
2001/0045367 A1 * 11/2001 Bisbal et al. ..... 206/223

* cited by examiner

*Primary Examiner*—Mickey Yu
*Assistant Examiner*—Faye Francis
(74) *Attorney, Agent, or Firm*—McKee, Voorhees & Sease, P.L.C.

(57) ABSTRACT

A package contains a product and a card. The package includes a window which permits viewing of the card from outside the package. A seller can insert the seller's card into the package through a slot in the package. The package can then be delivered to a recipient who can remove the seller's card and replace it with the recipient's own card. The product can then be delivered to a customer of the recipient.

11 Claims, 3 Drawing Sheets

CUSTOMER CUSTOMIZABLE INTERACTIVE PACKAGING AND METHOD FOR USING SAME

BACKGROUND OF THE INVENTION

The present invention relates to customer customizable interactive packaging and method for using same. It is a common practice for various types of businesses to give away products to their customers for promotional purposes. There is a need to provide packaging for such promotional materials that is capable of containing and displaying the business card of the seller, or other types of cards such as thank you cards, birthday cards, or other cards for special occassions. There is also a need for the ability to remove the seller's card and to replace it with a card of the purchaser.

Therefore a primary object of the present invention is the provision of an improved customer customizable interactive packaging and method for using same.

A further object of the present invention is the provision of an improved package which includes a slot for receiving a card.

A further object of the present invention is the provision of an improved package which includes a window behind which a card may be stored and viewed from outside the package.

A further object of the present invention is the provision of an improved package that houses a dental product or other product.

A further object of the present invention is the provision of an improved package which houses a product and which displays a card which can be removed and replaced.

A further object of the present invention is the provision of a method for delivering the package to a business person with the seller's card mounted in the package.

A further object of the present invention is the provision of a customer customizable interactive packaging containing a card wherein the card of the seller may be removed and replaced with the card of the business person receiving the package for delivering it to other potential customers.

A further object of the present invention is the provision of a customer customizable interactive packaging containing a card and method for using same which are economical in manufacture, durable in use, attractive in appearance, and efficient in operation.

BRIEF SUMMARY OF THE INVENTION

The foregoing objects may be achieved by a combination that includes a package having a package cavity therein. The package includes a plurality of package walls, at least some of which are transparent to show the contents within the package cavity. A pouch integrally formed in the package includes a transparent window therein. A card within the pouch includes indicia thereon providing information from a person. The indicia are visible from outside the package through the transparent window. The card is removable from the pouch and a second card is capable of insertion into the pouch. Any product may be within the package cavity.

According to another feature of the present invention the product is a toothbrush.

According to another feature of the present invention the pouch comprises a slit or slot through which the first card or second card may be inserted into the pouch.

According to another feature of the present invention the package includes at least a first flat surface located opposite from the transparent window. The first card or the second card when inserted into the pouch are located between the first flat surface of the package and the transparent window.

According to another feature of the present invention a second flat surface is located opposite from the first flat surface and also faces the transparent window. The card and the second card when inserted into the pouch are located between the first and second flat surfaces on one side of the card and the window on the other side of the card.

According to another feature of the present invention the first and second flat surfaces are formed by first and second projections that are positioned on opposite sides of the product within the package cavity.

According to another feature of the present invention the product is located on one side of the card and limits the movement of the card towards the package cavity.

According to another feature of the present invention the first and second flat surfaces of the first and second projections limit movement of the card towards the package cavity.

According to another feature of the present invention the first card and the second card each have a card thickness. The first and second flat surfaces and the transparent window are spaced apart a distance slightly greater than the card thickness.

According to another feature of the present invention a combination is provided including a package having one package cavity therein. The package has a plurality of package walls at least some of which are transparent to show the contents within the package cavity. A product is within the package cavity. A pouch slot is in one of the package walls and is sized to receive a card therein. The one package wall includes a transparent window therein. The transparent window has an interior window surface facing towards the package cavity and an exterior window surface facing away from the package cavity. A card includes one card surface containing indicia thereon providing information of a person. The one card surface faces towards the interior window surface so that the indicia thereon are visible from outside the package through the transparent window. The package has a first flat surface spaced a first distance from the interior window surface. The first distance is approximately the same, but slightly larger than the thickness of the business card. The business card is movable through the pouch slot from an inserted position wherein the business card is between the first flat surface and the interior window surface to a removed position wherein the business card is completely outside the package.

The method of the present invention includes placing a product within the package. The product is preferred to be a dental product, but the present invention can utilize any product within the packaging. Next, a card is placed within a pouch in the package, the pouch having a transparent window. The card may be a business card or any other type of card desired. Indicia on the card are made visible through the transparent window. The card can be removed from the pouch and a second card inserted into the pouch in the place of the first card so that indicia of the second card are visible through the transparent window.

According to another feature of the present invention the method comprises delivering the package having the card of a seller in the pouch to a first customer. The card of the seller is then removed from the pouch and a second card of the first customer is inserted into the pouch. The package is then delivered to a second customer of the first customer with the second business card of the first customer therein.

DETAILED DESCRIPTION OF THE PREFERRED EMBODIMENT

Figure 1:
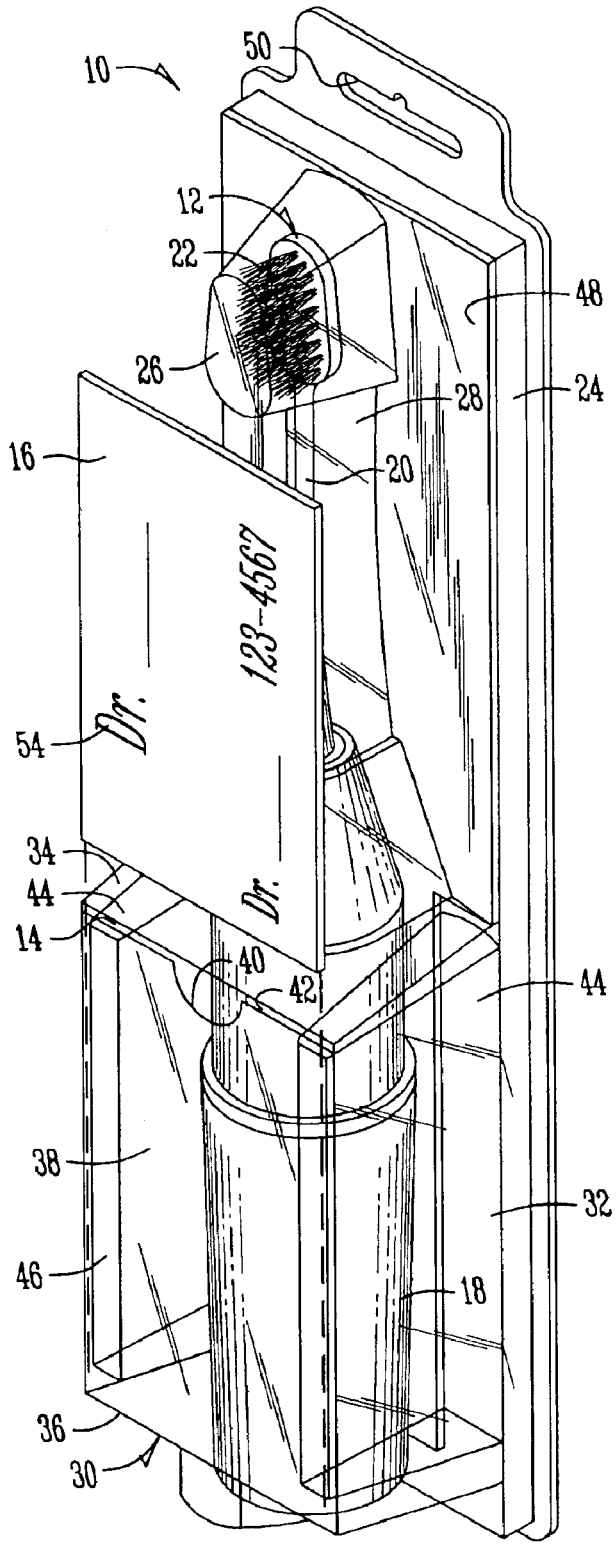
FIG. 1 is a perspective view of the present invention showing the card in exploded view removed from the slot.
Figure 2:
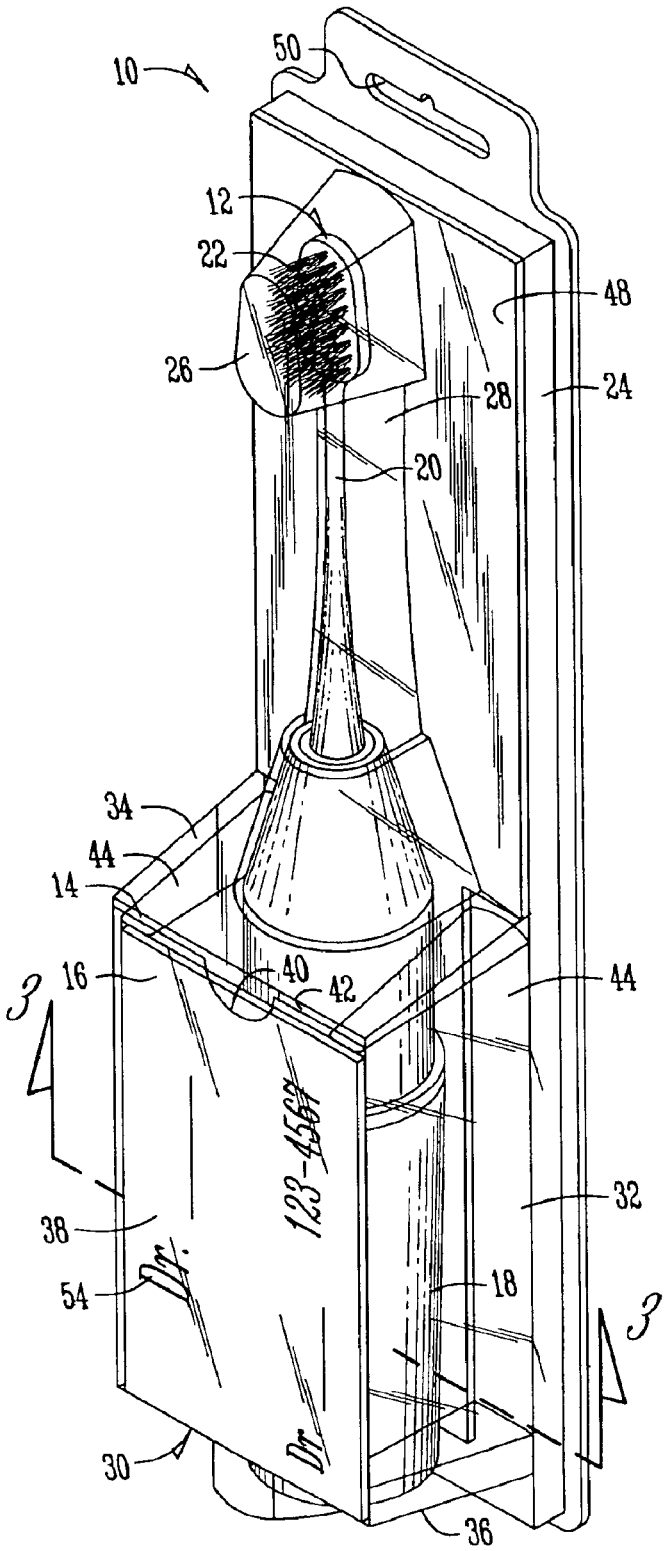
FIG. 2 is a view similar to FIG. 1, but showing the card within the slot.

Referring to the drawings, the numeral 10 generally designates a package of the present invention. Package 10 includes a toothbrush or other dental product 12 within a pouch 14 containing a business card 16. Any other product may be contained within the packaging. Also any type of card may be used.

Toothbrush 12 includes a handle 18, a shank 20 and a bristle end 22. The toothbrush may be of the battery operated type or it may be of other constructions without detracting from the invention. Furthermore the toothbrush could instead be another dental product, or conceivably the product could be a non-dental product.

The package 10 includes a rectangular portion 24 adjacent its back. It also includes a forwardly projecting bristle portion 26, shank portion 28, and base portion 30. The bristle portion 26, shank portion 28, and base portion 30 are shaped to conform to and enclose a package cavity 52 which encloses the toothbrush 12.

The base portion 30 includes side walls 32, a top wall 34, a bottom wall 36, and a forwardly facing window 38 which is transparent. The other walls are shown to be transparent as well, and any of the walls can be made transparent, translucent, or opaque. However the window 38 should be transparent for reasons explained hereafter. The upper edge of the window 38 includes a thumb notch 40, and a slot or slit 42 is provided and sized to fit the business card 16 and permit the card 16 to be inserted or removed from the pouch 14.

Extending inwardly from the back portion of package 10 are two projections 44 each of which includes a flat projection surface 46 closely spaced from the rear surface of window 38. The distance between window 38 and the flat surfaces 46 is a distance D1 (FIG. 3) which is slightly greater than the thickness of the card.

Positioned rearwardly of the toothbrush 12 and housed within the rectangular portion 24 of package 10 is a background card 48 which can include indicia thereon promoting and advertising the product that is contained within the package 10. At the upper end of the package 10 is a hook receiving opening 50. Card 16 includes a plurality of indicia 54 thereon which can be used to promote the seller of the product. It should be noted that the card 16 can be removed by the customer of the product and the customer's card placed into the slot 42 and the pouch 14.

The method of use of the present invention includes inserting the card 16 of a seller into the slot 40 and pouch 14. The package 10 is then delivered to a customer such as a dentist or other distributor of the products within the package. The dentist or other distributor can then remove the card 16 of the seller and replace it with their own business card. Then the dentist or other distributor can give the product away to patients or customers with the business card of the dentist or distributor in the pouch.

Figure 3:
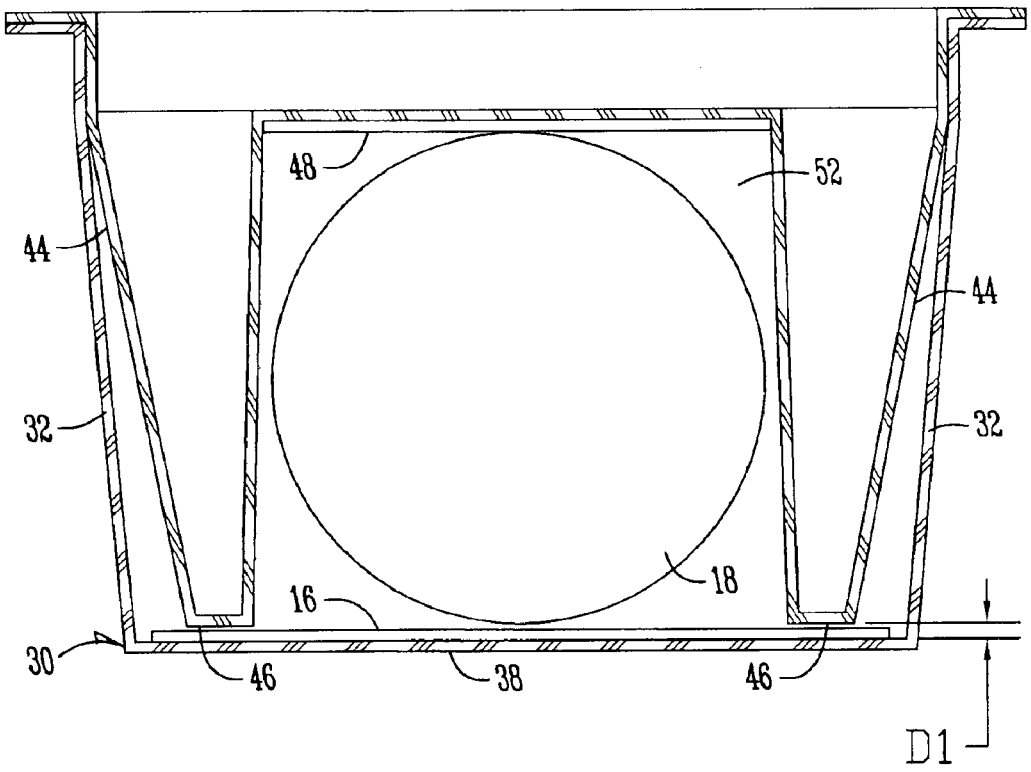
FIG. 3 is a sectional view taken along 3—3 of FIG. 2.

Referring to FIG. 3, the card 16 is held within the pouch by means of the two flat surfaces 46 and the transparent window 38. In addition, the handle 18 of the brush 12 engages the card at the center of the card. Thus the first surface 46, the second surface 46 and the handle 18 provide three contact points for engaging the card 16 and limiting the movement of the card 16 towards the package cavity 52.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

What is claimed is:

1. In combination:

a package having a package cavity therein, the package having a plurality of package walls, at least some of which are transparent to show the contents within the package cavity;

a pouch integrally formed in the package and having a transparent window therein, the pouch having a slit therein for access to the pouch;

a first flat surface and a second flat surface both located opposite from and facing the transparent window;

a first card within the pouch overlaying the first and second flat surfaces in the transparent window, the first card having indicia thereon providing information of a person, the indicia being visible from outside the package through the transparent window;

the first card being removable from the slit of the pouch and a second card being capable of insertion into the pouch through the slit thereof, whereby the second card, when inserted into the pouch overlays the first and second flat surfaces and faces the transparent window;

a product within the package cavity.

2. The combination according to claim 1 wherein the product is a toothbrush.

3. The combination according to claim 1 wherein the first and second flat surfaces are formed by first and second projections that are positioned on opposite sides of the product within the package cavity.

4. The combination according to claim 3 wherein the product is located on the one side of the first card and limits the movement of the card toward the package cavity.

5. The combination according to claim 3 wherein the first and second flat surfaces of the first and second projections limit the movement of the first card toward the package cavity.

6. The combination according to claim 3 wherein the first card and the second card each have a card thickness, the first and second flat surfaces and the transparent window being spaced apart a distance slightly greater than the card thickness.

7. In combination:

a package having a package cavity therein, the package having a plurality of package walls, at least some of which are transparent to show the contents within the package cavity;

a product within the package cavity;

a pouch slot in one of the package walls sized to receive a card therein, the one package wall having a transparent window therein, the transparent window having an interior window surface facing toward the package cavity and an exterior window surface facing away from the package cavity;

a card having one card surface and an opposite card surface, the one card surface containing indicia thereon providing information of a person, the one card surface facing toward the interior window surface so that the indicia thereon are visible from outside the package through the transparent window;

the card having a thickness, and the package having a first flat surface and a second flat surface spaced a first distance from the interior window surface, the first distance being approximately the same, but slightly larger than the thickness of the card;

the card being movable through the pouch slot from an inserted position wherein the card is overlays the first and second flat surfaces and the transparent window being on and facing the one card surface and the first and second flat surfaces being on and facing the opposite card surface, to a removed position wherein the card is completely outside the package.

8. The combination according to claim 7 wherein the package includes a back wall the first and second flat surfaces being on first and second projections respectively that extend from the back wall toward the window.

9. The combination according to claim 8 wherein the first and second projections form side walls to the package cavity, the product being between the first and second projections and being on the one side of the card.

10. In combination:

a package having a package cavity therein, the package having a plurality of package walls, at least some of the package walls being transparent to show the contents within the package cavity;

a tooth brush within the package cavity, the tooth brush having a bristle, a shank, and a base;

the package walls comprising a bristle portion, a shank portion, and a base portion shaped to conform to the bristle, shank, and base of the toothbrush;

a pouch slot in one of the package walls sized to receive a business card therein, the one package wall having a transparent window therein, the transparent window having an interior window surface facing toward the package cavity and an exterior window surface facing away from the package cavity;

a business card having a first card surface containing indicia thereon providing contact information of a person, the first card surface facing toward the interior window surface so that the indicia thereon are visible from outside the package through the transparent window;

the business card having a thickness, and the package having a first flat surface spaced a first distance from the interior window surface, the first distance being approximately the same, but slightly larger than the thickness of the business card;

the business card being movable through the pouch slot from an inserted position wherein the business card is between the first flat surface of the package and the interior window surface to a removed position wherein the business card is completely outside the package.

11. The combination of claim 10 wherein the first flat surface of the package and the toothbrush both engage a second flat surface of the business card opposite from the first flat surface of the business card.

* * * * *